US011300926B2

(12) United States Patent
Cusin et al.

(10) Patent No.: US 11,300,926 B2
(45) Date of Patent: Apr. 12, 2022

(54) PROCESS FOR FABRICATING A SILICON HAIRSPRING

(71) Applicant: Nivarox-FAR S.A., Le Locle (CH)

(72) Inventors: Pierre Cusin, Villars-Burquin (CH); Marco Verardo, Les Bois (CH)

(73) Assignee: Nivarox-FAR S.A., Le Locle (CH)

( * ) Notice: Subject to any disclaimer, the term of this patent is extended or adjusted under 35 U.S.C. 154(b) by 14 days.

(21) Appl. No.: 16/982,418

(22) PCT Filed: Mar. 21, 2019

(86) PCT No.: PCT/EP2019/057160
§ 371 (c)(1),
(2) Date: Sep. 18, 2020

(87) PCT Pub. No.: WO2019/180177
PCT Pub. Date: Sep. 26, 2019

(65) Prior Publication Data

US 2021/0080909 A1 Mar. 18, 2021

(30) Foreign Application Priority Data

Mar. 21, 2018 (EP) ..... 18163053

(51) Int. Cl.
*G04B 17/06* (2006.01)
*G04B 17/22* (2006.01)
*G04B 17/26* (2006.01)

(52) U.S. Cl.
CPC ..... *G04B 17/066* (2013.01); *G04B 17/227* (2013.01); *G04B 17/26* (2013.01)

(58) Field of Classification Search
CPC ..... G04B 17/066; G04B 17/26; G04B 17/227
See application file for complete search history.

(56) References Cited

U.S. PATENT DOCUMENTS

2015/0301502 A1 10/2015 Cusin et al.
2017/0176940 A1 6/2017 Niedermann et al.
2017/0176941 A1 6/2017 Kohler et al.
2017/0371300 A1 12/2017 Ikeda
2020/0379408 A1* 12/2020 Despont ..... G04B 17/066
(Continued)

FOREIGN PATENT DOCUMENTS

CH 711 248 A2 12/2016
CH 711 962 A2 6/2017
CN 104737989 A 7/2015
(Continued)

OTHER PUBLICATIONS

Combined Chinese Office Action and Search Report dated Mar. 26, 2021 in Chinese Patent Application No. 201980017845.2 (with English translation of Office Action ), 12 pages.
(Continued)

*Primary Examiner* — Moshe Wilensky
(74) *Attorney, Agent, or Firm* — Oblon, McClelland, Maier & Neustadt, L.L.P.

(57) ABSTRACT

A process for fabricating a hairspring having a final stiffness includes the steps of fabricating a hairspring to thickened dimensions, and determining the initial stiffness of the hairspring formed in order to remove the volume of material to obtain the hairspring having the dimensions required for said final stiffness.

7 Claims, 2 Drawing Sheets

(56) References Cited

U.S. PATENT DOCUMENTS

2021/0026299 A1* 1/2021 Jeanneret ..... G04B 17/066

FOREIGN PATENT DOCUMENTS

| | | | |
|---|---|---|---|
| CN | 106896700 | A | 6/2017 |
| CN | 106896708 | A | 6/2017 |
| CN | 107003641 | A | 8/2017 |
| EP | 2 781 968 | A1 | 9/2014 |
| EP | 3 181 938 | A1 | 6/2017 |
| EP | 3 232 277 | A1 | 10/2017 |
| JP | 2015-179067 | A | 10/2015 |
| JP | 2016-133495 | A | 7/2016 |
| JP | 2016-173358 | A | 9/2016 |
| JP | 2017-44533 | A | 3/2017 |

OTHER PUBLICATIONS

Indian Office Action dated Jun. 3, 2021 in Indian Patent Application No. 202047040074, 5 pages.
International Search Report dated May 23, 2019 in PCT/EP2019/057160 filed on Mar. 21, 2019, 2 pages.
International Preliminary Examination Report dated Jul. 8, 2020 in PCT/EP2019/057160 filed on Mar. 21, 2019, 7 pages.
Notice of the Reason for Refusal dated Nov. 30, 2021 in Application No. 2020-549548, 9 pgs.

* cited by examiner

PROCESS FOR FABRICATING A SILICON HAIRSPRING

FIELD OF THE INVENTION

The invention relates to a process for fabricating a silicon hairspring and, more specifically, to such a hairspring used as compensating hairspring cooperating with a balance of known inertia to form a resonator having a predetermined frequency.

BACKGROUND OF THE INVENTION

It is explained in document EP 1 422 436, incorporated by reference into the present application, how to form a compensating hairspring comprising a silicon core coated with silicon dioxide and cooperating with a balance of known inertia in order to thermally compensate the assembly of said resonator.

Fabricating such a compensating hairspring provides many advantages but also has drawbacks. Specifically, the step of etching several hairsprings in a silicon wafer offers a considerable geometric dispersion between the hairsprings of one and the same wafer and a greater dispersion between the hairsprings of two wafers etched at different times. Incidentally, the stiffness of each hairspring etched with the same etching pattern is variable creating considerable fabrication dispersions.

SUMMARY OF THE INVENTION

The objective of the present invention is to overcome all or some of the drawbacks mentioned above by providing a process for fabricating a hairspring, the dimensions of which are precise enough not to need alteration.

For this purpose, the invention relates to a process for fabricating a silicon hairspring having a known final stiffness comprising the following steps:

a) providing an SOI wafer successively comprising a silicon "handle" layer, a silicon oxide bonding layer and a silicon "device" layer;
b) growing a silicon oxide layer on the surface of the wafer;
c) carrying out photolithography on the "device" layer to form a resist mask;
d) etching the silicon oxide layer through the resist mask formed previously;
e) carrying out deep reactive-ion etching in order to form the silicon hairspring;
f) growing a silicon oxide layer on the surface of the silicon, the oxide layer serving as protection for the components;
g) etching the "handle" layer to expose the bonding layer and then releasing the hairspring, the hairspring being held on the wafer by at least one attachment;
h) determining the initial stiffness of the hairspring and calculating the coil dimensions to be obtained in order to obtain the hairspring having a final stiffness;
i) oxidizing the hairspring formed in order to transform said thickness of silicon-based material to be removed into silicon dioxide and to thus form an oxidized hairspring;
j) removing the oxide from the oxidized hairspring making it possible to obtain a silicon-based hairspring having the overall dimensions necessary for obtaining the final stiffness;

k) re-oxidizing the hairspring to obtain a hairspring having a final stiffness and to adjust the thermal performances of said hairspring;

A compensating hairspring is thus obtained which, advantageously according to the invention, comprises a silicon-based core and a silicon oxide-based coating. Advantageously according to the invention, the compensating hairspring therefore has a very high dimensional accuracy and, incidentally, a very fine thermal compensation of the resonator assembly.

It is therefore understood that the process makes it possible to guarantee a very high dimensional accuracy of the hairspring and, incidentally, a behaviour of its stiffness according to the temperature which will compensate for the drifts of the assembly that it forms with a balance.

In accordance with other advantageous variants of the invention:

step e) is carried out by means of chemical etching;

step g) comprises the following phases:

g1) carrying out a photolithography and a dry etching to expose the silicon of the "handle" layer;
g2) etching the "handle" layer with a potassium hydroxide solution, a tetramethylammonium hydroxide solution, or by DRIE etching;

during step e), several hairsprings are formed in one and the same wafer to dimensions greater than the dimensions needed in order to obtain several hairsprings having one initial stiffness or several hairsprings having several initial stiffnesses;

step h) comprises the following phases:

h1) measuring the frequency of an assembly comprising the hairspring formed during step e) coupled with a balance endowed with a known inertia and deducing from the measured frequency, the initial stiffness of the hairspring formed;
h2) calculating, from the determination of the initial stiffness of the hairspring, the coil dimensions to be obtained in order to obtain said hairspring having a final stiffness;

after step k), the process further comprises the following step:

l) forming, on at least one portion of said hairspring having a predetermined stiffness, a thin layer on a portion of the outer surface of said hairspring making it possible to form a hairspring that is less sensitive to climatic variations and to interferences of an electrostatic nature.

BRIEF DESCRIPTION OF THE DRAWINGS

Other distinctive features and advantages will become clearly apparent from the description thereof provided below, by way of wholly nonlimiting indication, with reference to the appended drawings, in which.

DETAILED DESCRIPTION OF THE PREFERRED EMBODIMENTS

Figure 2A:
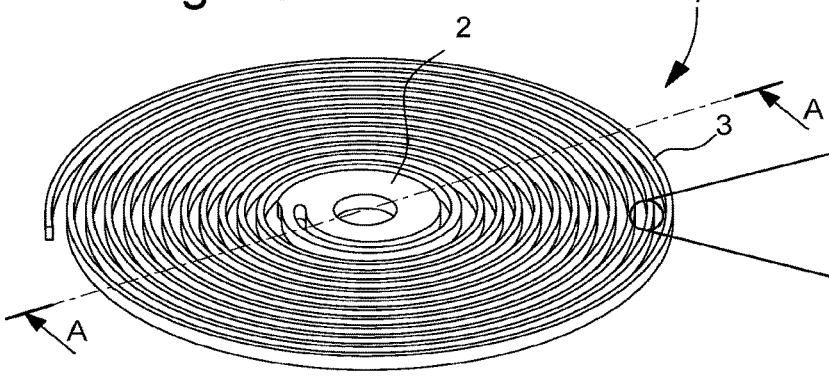
FIGS. 2*a* and 2*b* respectively illustrate a perspective view and a cross-sectional view of a hairspring obtained according to a process in accordance with the invention.

The invention relates to a compensating hairspring 1 visible in FIG. 2*a* and also to the process for fabricating same that makes it possible to guarantee a very high dimensional accuracy of the hairspring and, incidentally, to guarantee a more precise stiffness of said hairspring.

According to the invention, the compensating hairspring 1 is formed from a material, optionally coated with a thermal compensation layer, and intended to cooperate with a balance of known inertia.

The use of a material, for example based on silicon, glass or ceramic, for the fabrication of a hairspring offers the advantage of being accurate via the existing etching methods and of having very good mechanical and chemical properties while being insensitive or not very sensitive to magnetic fields. It must however be coated or surface-modified in order to be able to form a compensating hairspring.

Preferentially, the silicon-based material used as compensating hairspring may be monocrystalline silicon irrespective of its crystalline orientation, doped monocrystalline silicon irrespective of its crystalline orientation, amorphous silicon, porous silicon, polycrystalline silicon, silicon nitride, silicon carbide, quartz irrespective of its crystalline orientation or silicon oxide. Of course, other materials may be envisaged such as glass, ceramic, a cermet, a metal or a metal alloy. For simplification, the explanation below will focus on a silicon-based material.

Every type of material may be surface modified or coated with a layer in order to thermally compensate the base material as explained above.

Figure 1:
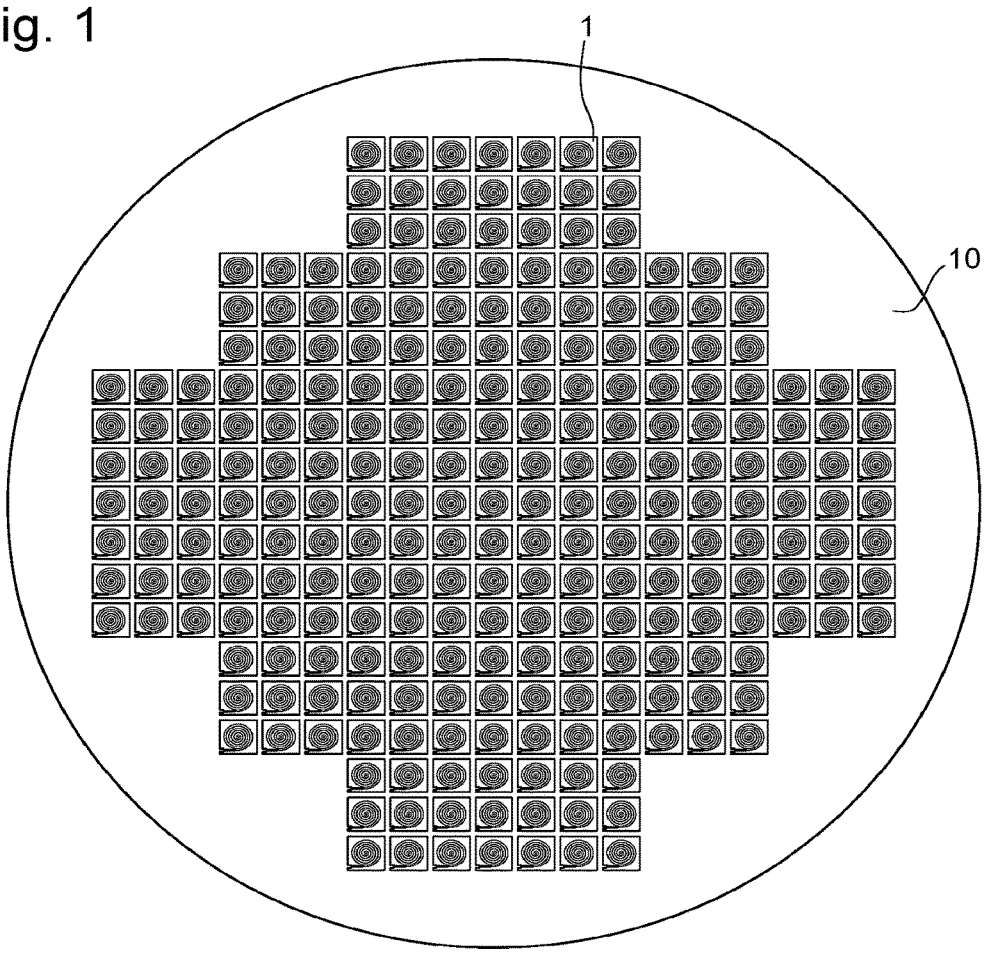
FIG. 1 illustrates a wafer with a multitude of hairsprings obtained according to a process in accordance with the invention.
Figure 3:
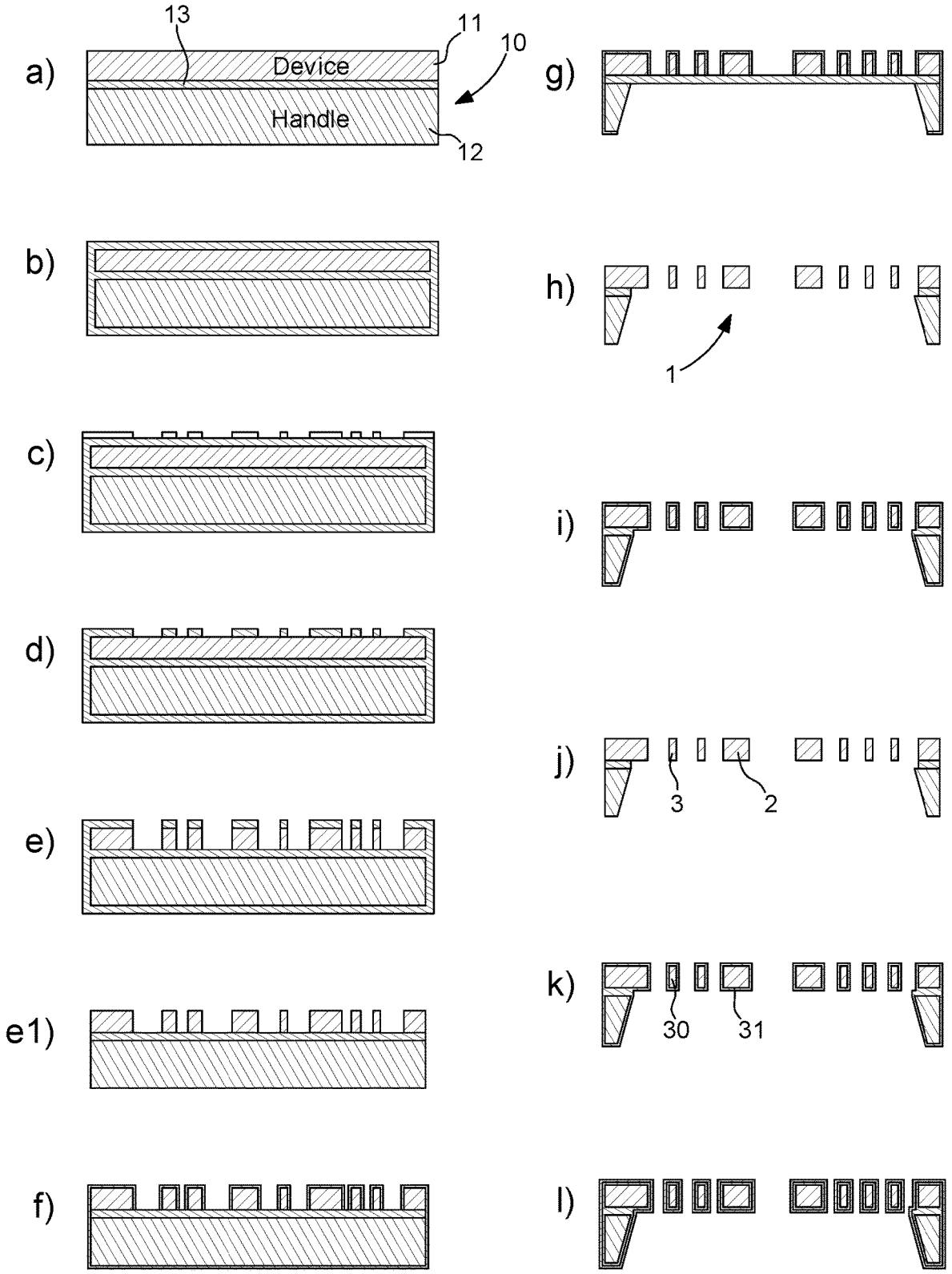
FIG. 3 illustrates the various steps of a process in accordance with the invention.

Thus, the invention relates to a process for fabricating a silicon hairspring 1 visible in FIG. 3. In the interests of legibility and understanding, the steps of the process represent only a median cross section along the line A of a single silicon hairspring 1 formed in the wafer 10 from FIG. 1, the number of coils 3 of the hairspring 1 being reduced to facilitate the interpretation of the figures.

According to the invention, the process comprises, as illustrated in FIG. 3, a first step a) which consists in providing SOI wafers 10, i.e. composed of two layers of silicon 11 and 12, bonded to one another by a silicon oxide layer 13. Each of these three layers has one or more very precise roles.

The upper silicon layer 11, referred to as the "device" and formed from a sheet of monocrystalline silicon (the main orientations of which may be varied), has a thickness which will determine the final thickness of the component to be fabricated, typically, in watchmaking, between 100 and 200 μm.

The lower silicon layer 12, referred to as the "handle", is essentially used as mechanical support, so as to be able to carry out the process on a sufficiently rigid assembly (which the reduced thickness of the "device" is not able to guarantee). It is also formed from a sheet of monocrystalline silicon, in general having an orientation similar to the "device" layer.

The oxide layer 13 makes it possible to intimately bond the two silicon layers 11 and 12. Moreover, it will also serve as a stop layer during subsequent operations.

Step b) which follows consists in growing, on the surface of the wafer(s) 10, a silicon oxide layer, by exposing the wafer(s) to an oxidizing atmosphere at high temperature. The layer varies depending on the thickness of the "device" to be structured. It typically lies between 1 and 4 μm.

Step c) of the process will make it possible to define, for example in a positive resist, the patterns that it is desired to produce subsequently in the silicon wafer 10. This step comprises the following operations:

the resist is deposited, for example by spin coating, as a very thin layer having a thickness of between 1 and 2 μm, once dried, this resist, having photolithographic properties, is exposed through a photolithographic mask (transparent sheet covered with a layer of chromium, itself representing the desired patterns) using a light source;

in the precise case of a positive resist, the exposed zones of the resist are then removed by means of a solvent, then revealing the oxide layer. In this case, the zones still covered with resist define the zones not be attacked in the subsequent operation of deep reactive-ion etching (DRIE) of the silicon.

During step d), the exposed zones or on the contrary the zones covered with resist are then made use of. A first etching procedure makes it possible to transfer to the previously grown silicon oxide the patterns defined in the resist in the preceding steps. Still from the point of view of repeatability of the fabrication procedure, the silicon oxide is structured by directional dry plasma etching that reproduces the quality of the sides of the resist acting as mask for this operation.

Once the silicon oxide is etched in the open zones of the resist, the silicon surface of the upper layer 11 is then exposed and ready for DRIE etching. The resist may or may not be retained depending on whether it is desired to use the resist as mask during the DRIE etching.

The exposed silicon that is not protected by the silicon oxide is etched in a direction perpendicular to the surface of the wafer (Bosch® DRIE anisotropic etching). The patterns formed firstly in the resist, then in the silicon oxide, are "projected" into the thickness of the "device" layer 11.

When the etching comes to the silicon oxide layer 13 bonding the two silicon layers 11 and 12, the etching stops. Specifically, like the silicon oxide acting as mask during the Bosch® process and resisting the etching itself, the buried oxide layer 13, of the same nature, also resists the etching.

The silicon "device" layer 11 is then structured throughout its thickness by the defined patterns representing the components to be fabricated, now revealed by this DRIE etching, namely a hairspring 1 comprising coils 3 and a collet 2.

The components remain firmly attached to the "handle" layer 12 to which they are bonded by the buried silicon oxide layer 13.

Of course, the process could not be limited to DRIE etching during step e). By way of example, step e) could just as well be obtained by chemical etching in a same silicon-based material.

During step e), several hairsprings may be formed in the same wafer to dimensions greater than the dimensions needed in order to obtain several hairsprings having one initial stiffness or several hairsprings having several initial stiffnesses.

Following step e), during a sequence el), the residues of the passivation resist resulting from the Bosch® procedure are then removed, and the oxide having served as mask in the DRIE etching is removed in aqueous solution based on hydrofluoric acid.

During a step f), a silicon oxide layer is again grown on the surface of the silicon (around the "device" layer 11 and "handle" layer 12), this oxide layer will serve as protection for the components during the operation that serves to release them by separating them from the "handle" layer 12.

A second photolithography operation similar to the first one carried out during step c) is carried out on the back of the wafer 10 (therefore on the "handle" layer 12). To do this, the wafer 10 is turned over, the resist is deposited thereon, then exposed through a mask.

The zone of the resist exposed is then removed by means of a solvent, then revealing the oxide layer formed previously and which is then structured via dry etching.

In the following step g), a complete etching of the exposed "handle" layer 12 is carried out by means of an aqueous solution, based on potassium hydroxide (KOH), tetramethylammonium hydroxide, or else by DRIE etching. These solutions are well known for easily etching silicon, while sparing the silicon oxide.

During step g1) for completely releasing the components, the various silicon oxide layers are then etched by means of wet etching with a solution based on hydraulic acid. Advantageously, the hairsprings 1 formed are held in a frame via at least one attachment, the frame and the attachments having been formed at the same time as the hairsprings during the DRIE etching step e).

The process comprises a step h) intended to determine the initial stiffness of the hairspring. Such a step h) may be carried out directly on the hairspring still attached to the wafer 10 or on the assembly or on a sample of the hairsprings still attached to the wafer or on a hairspring detached from the wafer.

Preferentially, according to the invention, step h) comprises a first phase h1) intended to measure the frequency of an assembly comprising the hairspring coupled with a balance endowed with a known inertia then deducing therefrom the initial stiffness of the hairspring.

The oscillation frequency of the balance-hairspring assembly makes it possible to determine the angular stiffness of the hairspring tested, and thereby, the precise dimensions of the cross section of the coil 3 of the hairspring 1 (its thickness mainly, the height being known, since it is the thickness of the "device" layer of the base substrate).

Such a measurement phase may in particular be dynamic and carried out according to the teachings of document EP 2 423 764, incorporated by reference in the present application. However, alternatively, a static method, carried out according to the teachings of document EP 2 423 764, may also be used to determine the stiffness of the hairspring.

Of course, as explained above, since the process is not limited to the etching of a single hairspring per wafer, step h) may also consist of a determination of the average initial stiffness of a representative sample or of all of the hairsprings formed on one and the same wafer.

During the second phase h2), the coil dimensions to be obtained are calculated, from the determination of the initial stiffness of the hairspring, in order to obtain the overall dimensions necessary for obtaining said hairspring having a desired stiffness (or final stiffness).

The process continues with a sequence intended to remove the excess material from the hairspring to the dimensions necessary with a view to obtaining the hairspring having a final stiffness.

Step i) consists in oxidizing the hairspring in order to transform said thickness of silicon-based material to be removed into silicon dioxide and to thus form an oxidized hairspring. Such a phase may, for example, be obtained by thermal oxidation. Such a thermal oxidation may, for example, be carried out between 800 and 1200° C. under an oxidizing atmosphere using water vapour or dioxygen gas making it possible to form silicon oxide on the hairspring. During this step, the fact that silicon oxide grows evenly is exploited, the rate of oxidation and the thickness which result therefrom are perfectly controlled by a person skilled in the art which makes it possible to ensure the uniformity of the oxide layer.

Step i) continues with a step j) intended to remove the oxide from the hairspring making it possible to obtain a silicon-based hairspring having the overall dimensions necessary for obtaining the final stiffness. Such a step is obtained by a chemical etching. Such a chemical etching may be carried out, for example, by means of a solution based on hydrofluoric acid that makes it possible to remove the silicon oxide from the hairspring.

Steps i) and j) make it possible to bring the dimensions of the coil 3 to intermediate values determined during the calculation step h2).

Lastly, step k) consists in oxidizing the hairspring again to coat it with a silicon dioxide layer in order to form a hairspring 1 which is thermally compensated. Such a step may, for example, be obtained by thermal oxidation. Such a thermal oxidation may, for example, be carried out between 800 and 1200° C. under an oxidizing atmosphere using water vapour or dioxygen gas making it possible to form silicon oxide on the hairspring.

Figure 2B:
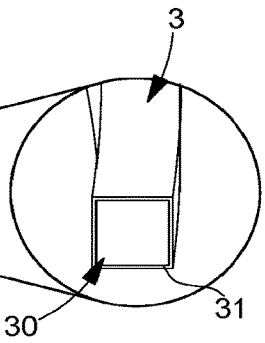

The compensating hairspring 1 as illustrated in FIGS. 2*a* and 2*b* is thus obtained which, advantageously according to the invention, comprises a core 30 based on silicon and a coating 31 based on silicon oxide.

This second oxidation makes it possible to adjust both the mechanical performance (stiffness) and thermal performance (temperature compensation) of the future hairspring 1. At this stage, the dimensions of the coil 3 correspond to the desired angular stiffness requirement and the grown silicon oxide layer makes it possible to adjust the stiffness as a function of the dimensional change of the balance/hairspring assembly depending on the temperature.

Advantageously according to the invention, it is thus possible to fabricate, without further complexity, a hairspring 1 comprising in particular:

- one or more coils 3 having cross section(s) more accurate than the cross section obtained by a single etching;
- variations in thickness and/or in pitch along the coil;
- a one-piece collet 2;
- an inner coil of Grossmann curve type;
- a one-piece stud-pinning attachment;
- a one-piece outer setting element;
- a portion of the outer coil that is overthick compared to the rest of the coils.

The process may also comprise a metallization step l). Specifically, the growth of a considerable silicon oxide layer on the surface of the hairsprings does not provide only advantages. This layer traps and fixes electric charges, which will result in electrostatic binding phenomena either with the surroundings of the hairspring, or of the coils with one another.

This layer also has hydrophilic properties, and it is known that the absorption of moisture gives rise to a drift in the stiffness of the hairspring and therefore of the running of the watch.

Therefore, a thin layer of a metal such as chromium, titanium, tantalum or an alloy thereof simultaneously makes the surface of the hairspring 1 waterproof and conductive, eliminating the effects mentioned above. Such a layer may be obtained according to the teachings of document EP 2 920 653, incorporated by reference in the present application.

The thickness of this thin layer is selected to be as thin as possible so as not to disrupt the performances adjusted above. A suitable heat treatment guarantees the good adhesion of the thin layer.

Finally, the process may also comprise the step m) intended to separate the hairsprings 1 from the wafer 10 and assemble them with a balance of known inertia in order to form a resonator of balance-hairspring type which is optionally thermally compensated, i.e. the frequency of which is optionally sensitive to the temperature variations.

Of course, the present invention is not limited to the example illustrated but has the potential for various alternative forms and modifications which will be apparent to a person skilled in the art. In particular, as explained above, the balance, even if it has a predefined inertia of construction, may comprise movable inertia blocks that make it possible to offer a setting parameter before or after the sale of the timepiece.

The invention claimed is:

1. A process for fabricating a hairspring comprising the following steps:

a) providing an SOI wafer successively comprising a silicon device layer, a silicon oxide bonding layer and a silicon handle layer;

b) growing a first silicon oxide layer on a surface of the wafer;

c) carrying out photolithography on the device layer to form a resist mask;

d) etching the first silicon oxide layer through the resist mask formed previously;

e) carrying out deep reactive-ion etching in order to form the silicon hairspring;

f) growing a second silicon oxide layer on the surface of the wafer, the second silicon oxide layer serving as protection for the hairspring formed;

g) etching the handle layer to expose the bonding layer and then releasing the hairspring, the hairspring being held on the wafer by at least one attachment;

h) determining a stiffness of the hairspring formed and calculating an excess material of the coil in order to obtain a hairspring of final stiffness;

i) oxidizing the hairspring formed in order to transform said thickness of silicon-based material to be removed into silicon oxide and to thus form an oxidized hairspring;

j) removing the oxide from the oxidized hairspring to form a silicon-based hairspring having overall dimensions necessary for obtaining the final stiffness;

k) re-oxidizing the silicon-based hairspring to form the hairspring having the final stiffness and to adjust thermal performances of said hairspring.

2. The fabrication process according to claim 1, wherein step e) is carried out by means of chemical etching.

3. The fabrication process according to claim 1, wherein step g) comprises the following phases:

g1) carrying out photolithography and etching to expose the silicon of the handle layer; and g2) etching the handle layer with a potassium hydroxide solution, a tetramethylammonium hydroxide solution, or deep reactive-ion etching.

4. The fabrication process according to claim 1, wherein, during step e), several hairsprings are formed in one and the same wafer to dimensions greater than the dimensions needed in order to obtain several hairsprings having one initial stiffness or several hairsprings having several initial stiffnesses.

5. The fabrication process according to claim 1, wherein step h) comprises the following phases:

h1) measuring a frequency of an assembly comprising the hairspring formed during step e) coupled with a balance endowed with a known inertia and deducing from the measured frequency, the initial stiffness of the hairspring formed; and h2) calculating, from the determination of the initial stiffness of the hairspring, coil dimensions to be obtained in order to obtain the hairspring having the final stiffness.

6. The fabrication process according to claim 1, wherein, after step k), the process further comprises the following step:

l) forming, on at least one portion of the hairspring having the final stiffness, a thin layer on a portion of an outer surface of the hairspring having the final thickness to form a hairspring that is less sensitive to climatic variations and to interferences of an electrostatic nature.

7. The fabrication process according to claim 6, wherein the thin-layer comprises chromium, titanium, tantalum or an alloy thereof.

* * * * *